US011939093B2

(12) United States Patent
Rivola

(10) Patent No.: US 11,939,093 B2
(45) Date of Patent: Mar. 26, 2024

(54) UNIT FOR OVER-WRAPPING FILTER BAGS FOR INFUSION PRODUCTS

(71) Applicant: I.M.A. INDUSTRIA MACCHINE AUTOMATICHE S.p.A., Ozzano Dell'Emilia (IT)

(72) Inventor: Sauro Rivola, Ozzano Dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 260 days.

(21) Appl. No.: 17/763,183

(22) PCT Filed: Oct. 19, 2020

(86) PCT No.: PCT/IB2020/059804
§ 371 (c)(1),
(2) Date: Mar. 23, 2022

(87) PCT Pub. No.: WO2021/084370
PCT Pub. Date: May 6, 2021

(65) Prior Publication Data

US 2022/0227510 A1 Jul. 21, 2022

(30) Foreign Application Priority Data

Oct. 28, 2019 (IT) ..... 102019000019812

(51) Int. Cl.
*B65B 29/04* (2006.01)
*B65B 29/02* (2006.01)
*B65B 51/16* (2006.01)

(52) U.S. Cl.
CPC ..... *B65B 29/04* (2013.01); *B65B 29/028* (2017.08); *B65B 51/16* (2013.01)

(58) Field of Classification Search
CPC ..... B65B 29/04; B65B 29/028; B65B 51/16
See application file for complete search history.

(56) References Cited

U.S. PATENT DOCUMENTS 3,987,605 A 10/1976 Johnson
4,885,896 A 12/1989 Romagnoli
(Continued)

FOREIGN PATENT DOCUMENTS

CN 101970300 A 2/2011
CN 103402875 A 11/2013
(Continued)

OTHER PUBLICATIONS

Chinese Office Action dated Feb. 8, 2023 from counterpart Chinese Patent Application No. 202080075722.7.
(Continued)

*Primary Examiner* — Andrew M Tecco
*Assistant Examiner* — Nicholas E Igbokwe
(74) *Attorney, Agent, or Firm* — SHUTTLEWORTH & INGERSOLL, PLC; Timothy J. Klima

(57) ABSTRACT

A unit for over-wrapping filter bags includes a carousel rotating about a first axis with first and second grippers along a closed circular trajectory. A forming station for forming single sheets of over-wrapping material is arranged near the trajectory and includes a feeding device for feeding the sheets in a U-shape, synchronized with the first grippers. A first drum transports formed bags, rotates about a second axis and has grippers receiving the bags from a preceding station and releasing the bags from the first grippers with the U-shaped sheets in synchronization. A closing station includes a sealing gripper movable from a first position near the carousel, for picking the bag with the sheet the first gripper, to a second away position for closing the sheet and, lastly, to a third position near the carousel, for release of the enclosed bag to the second gripper.

11 Claims, 7 Drawing Sheets

(56) References Cited

U.S. PATENT DOCUMENTS

| | | | | |
|---|---|---|---|---|
| 5,802,820 | A * | 9/1998 | Romagnoli | B65B 61/24 53/529 |
| 10,793,347 | B2 * | 10/2020 | Rea | B65D 85/808 |
| 2002/0139087 | A1 * | 10/2002 | Ghirlandi | B65B 29/028 53/413 |
| 2009/0260640 | A1 * | 10/2009 | Campagnoli | B65B 41/02 131/58 |

FOREIGN PATENT DOCUMENTS

| | | | |
|---|---|---|---|
| CN | 103587745 | A | 2/2014 |
| CN | 108995868 | A | 12/2018 |
| EP | 762973 | A1 | 3/1997 |
| EP | 762974 | A1 | 3/1997 |
| EP | 765274 | A1 | 4/1997 |
| GB | 2202210 | A | 9/1988 |
| JP | 2003523897 | A | 8/2003 |
| WO | 2010067290 | A1 | 6/2010 |
| WO | 2012117308 | A1 | 9/2012 |
| WO | 2017145044 | A1 | 8/2017 |

OTHER PUBLICATIONS

International Search Report and Written Opinion dated Dec. 17, 2020 from counterpart International Patent Application No. PCT/IB2020/059804.

English translation of Japanese Office Action dated Dec. 23, 2023 from counterpart Japanese Patent Application No. 2022-525053.

* cited by examiner

UNIT FOR OVER-WRAPPING FILTER BAGS FOR INFUSION PRODUCTS

This application is the National Phase of International Application PCT/162020/059804 filed Oct. 19, 2020, which designated the U.S.

This application claims priority to Italian Patent Application No. 102019000019812 filed Oct. 28, 2019, which application is incorporated by reference herein.

TECHNICAL FIELD

This invention relates to a unit for over-wrapping filter bags for infusion products obtained from a machine for forming filter bags for infusion products, such as tea, coffee, chamomile (in powder, granular or leaf form).

BACKGROUND ART

The term filter bags is used to indicate at least two types of filter bag: the single-chamber filter bags, comprising, in a minimum configuration, a piece of filter material forming a chamber containing a dose of infusion product; and the double-chamber filter bags, again comprising a single piece of filter paper, but forming two separate chambers. Each chamber contains a dose of infusion product. The two chambers are folded towards each other forming a single upper end (in the shape of an upturned "V") and a bottom end in the shape of a "W".

The single-chamber and double-chamber filter bags can also be equipped with a tag and a tie string connecting the tag to the filter bag.

Lastly, an over-wrapping envelope may be added to the above-mentioned filter bags for wrapping and closing the single filter bag, in a hermetic or non-hermetic manner.

A first type of machine, used for making filter bags of the type called two-lobed, is known from patent documents EP762973, EP762974 and EP765274 (all in the name of the same Applicant).

A further prior art machine comprising an over-wrapping station is known from patent document GB 2 202 210.

The machine extends along a forming and feeding line on which are positioned:

- a station for feeding a web of filter paper along a feed surface;
- a station for feeding doses of product on the web of filter paper at predetermined distances;
- a tabularisation station for folding the strip on itself, wrapping the doses of product and, subsequently, longitudinally joining the strip;
- a station for folding individual pieces of filter paper with double chamber;
- a carousel, equipped with radially protruding grippers, positioned beneath the folding station and configured to receive individual pieces of folded filter paper; the carousel, moved stepwise about a horizontal axis, rotates each piece of filter paper to the operating stations, arranged one after another and stationary relative to a frame of the machine, to associate to the piece of filter paper a string, suitably wrapped around the piece of filter paper, and a tag in turn connected to the string.

In further machine solutions, depending on the type of filter bag to be formed, there may be (alternatively):

- a station for folding the open ends of the two chambers of the piece along the path of the carousel with their retaining by the knotting of the string on the same piece; or

- a further station for transversal closing of the ends of the piece before or at the same time as the separation from the remaining film.

The machine may also comprise a station for applying a sheet of over-wrapping material for each filter bag positioned along the path of the carousel, or at a further separate station.

The machine structured as described above operates intermittently, that is to say, stepwise for all the stations present along the feed line.

The stepwise operation places a limit on the productivity of the machine.

In order to overcome this type of problem, the same Applicant has devised and produced a new type of machine for making filter bags for infusion products (see patent document WO2017/145044) which is movable continuously and thanks to which there is a productivity greater than the productivity of the prior art machines, maintaining a high quality of the filter bag.

This solution basically comprises at least a carousel rotating continuously and having, on its circumferential surface a plurality of first gripping elements for holding a respective piece of filter material being formed and a plurality of stations associated with a corresponding gripping unit and configured to operate on the piece of filter material in order to form, partly or completely, a filter bag along at least one predetermined angular stretch of rotation of the movement carousel. Therefore, the basic concept of the machine is that it comprises a multiplicity of operating units, all operating a same operation on the piece of filter material, all independent of each other and driven continuously about an axis of rotation.

Upon completion of the operations on the piece of filter material, each operating station and the corresponding gripping unit arrive at an outfeed area of the movement carousel and release the piece in such a way that it can be transferred to a subsequent processing step/station, for example a further movement carousel.

As mentioned above, depending on the type of filter bag being formed, a single carousel defining the machine or more than one carousel in succession with each other and having a structure similar to that described above and defining the machine in its entirety, result in the definitive formation of the "naked" filter bag.

The latter can therefore be transferred (if required) to a station/unit for applying a sheet of over-wrapping material of the filter bag thus obtained so as to obtain a complete packaging of the filter bag.

The over-wrapping station or unit (of particular interest in this invention) must have an operating structure which is able to operate at the same high speeds as the carousel(s) present in the machine for picking up the filter bags from them and, simultaneously, can be able to prepare a sheet of over-wrapping material, wrap the sheet on a corresponding filter bag and then close/seal the sheet of over-wrapping material wrapped on the filter bag and then unload it in a collection zone.

AIM OF THE INVENTION

The aim of the invention is therefore to provide a unit for over-wrapping filter bags for infusion products obtained from a machine for forming filter bags for infusion products with continuous movement which is able to complete in a fast and precise fashion a cycle for forming the over-wrapping of the filter bag.

In particular, the aim of the invention is to provide a unit for over-wrapping filter bags for infusion products obtained from a machine for forming filter bags for infusion products which is able to prepare and apply an over-wrapping envelope on each filter bag, maintaining a reduced size of the over-wrapping station and a high flexibility at the high operating speeds of the machine.

Said aims are fully achieved by a unit for over-wrapping filter bags for infusion products obtained from a machine for forming filter bags for infusion products according to the appended claims.

BRIEF DESCRIPTION OF THE DRAWINGS

The invention will be described with reference to the accompanying drawings, provided by way of example only and without limiting the scope of the invention, in which.

DETAILED DESCRIPTION OF PREFERRED EMBODIMENTS OF THE INVENTION

Figure 1:
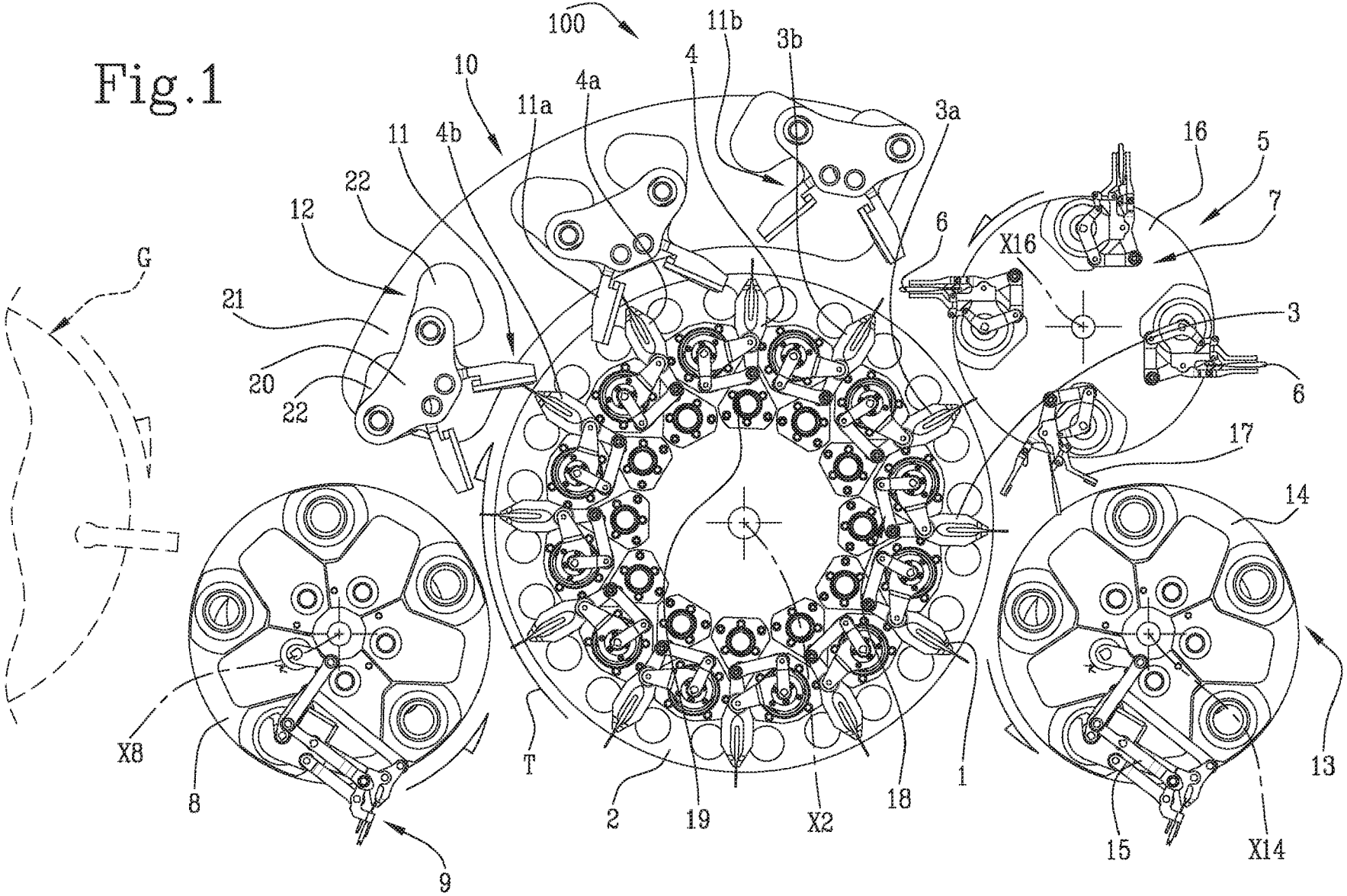
FIG. 1 is a front view of a unit for over-wrapping filter bags for infusion products according to the invention.

With reference to the accompanying drawings, in particular FIG. 1, a unit for over-wrapping filter bags 1 for infusion products, according to the invention, is denoted in its entirety by the numeral 100.

This unit 100 is used on machines for forming filter bags 1 containing infusion products, such as tea, coffee, chamomile dosed in powder, granular or leaf form.

The expression "filter bags" can be used to indicate at least two types of filter bag.

A first type, known as single-chamber, comprises a piece of filter material forming a single chamber containing a dose of infusion product.

A second type of filter bag, known as double-chamber, comprises a single piece of filter material, which forms two separate chambers. Each chamber contains a dose of infusion product. The two chambers are folded towards each other forming a single upper end (usually in the shape of an upturned "V") and a bottom end in the shape of a "W".

These two types of filter bag may be equipped with a gripping tag and a tie string connecting the tag to the filter bag 1 formed.

An outer over-wrapping envelope may also be added to wrap around and enclose each single filter bag 1 formed.

The machine on which the over-wrapping unit 100 may be used (even though not limited to that solution, but by way of example), starts from the concept of being able to obtain various types of filter bag, including those mentioned above (from the simpler single-chamber filter bag to the more complex double-chamber bag with tie string and tag in over-wrapping envelope) adding, when necessary, operating stations designed to perform the requested operation on the piece of filter material or on the filter bag (folding and/or applying tie string and tag), whilst maintaining a continuous operation of the machine (see also patent document WO2017/145044 by the same Applicant).

The unit 100 for over-wrapping filter bags 1 for infusion products, as mentioned, is obtained from a machine for forming filter bags 1 for infusion products starting from pieces of filter material each containing at least a dose of infusion product and provided, with a filter bag 1 formed, with a thread and a tag.

As illustrated in FIG. 1, the unit 100 for the over-wrapping comprises a carousel 2 rotating about a first axis X2 of rotation (in this case rotating in a clockwise direction).

The carousel 2 is equipped with at least one first 3 and one second 4 gripping means movable in rotation about the first axis X2 of rotation along a closed circular trajectory T.

The over-wrapping unit 100 also comprises a forming station 5 for forming single sheets 6 of over-wrapping material arranged close to the closed circular trajectory T of the first and second gripping means 3 and 4.

Figure 2:
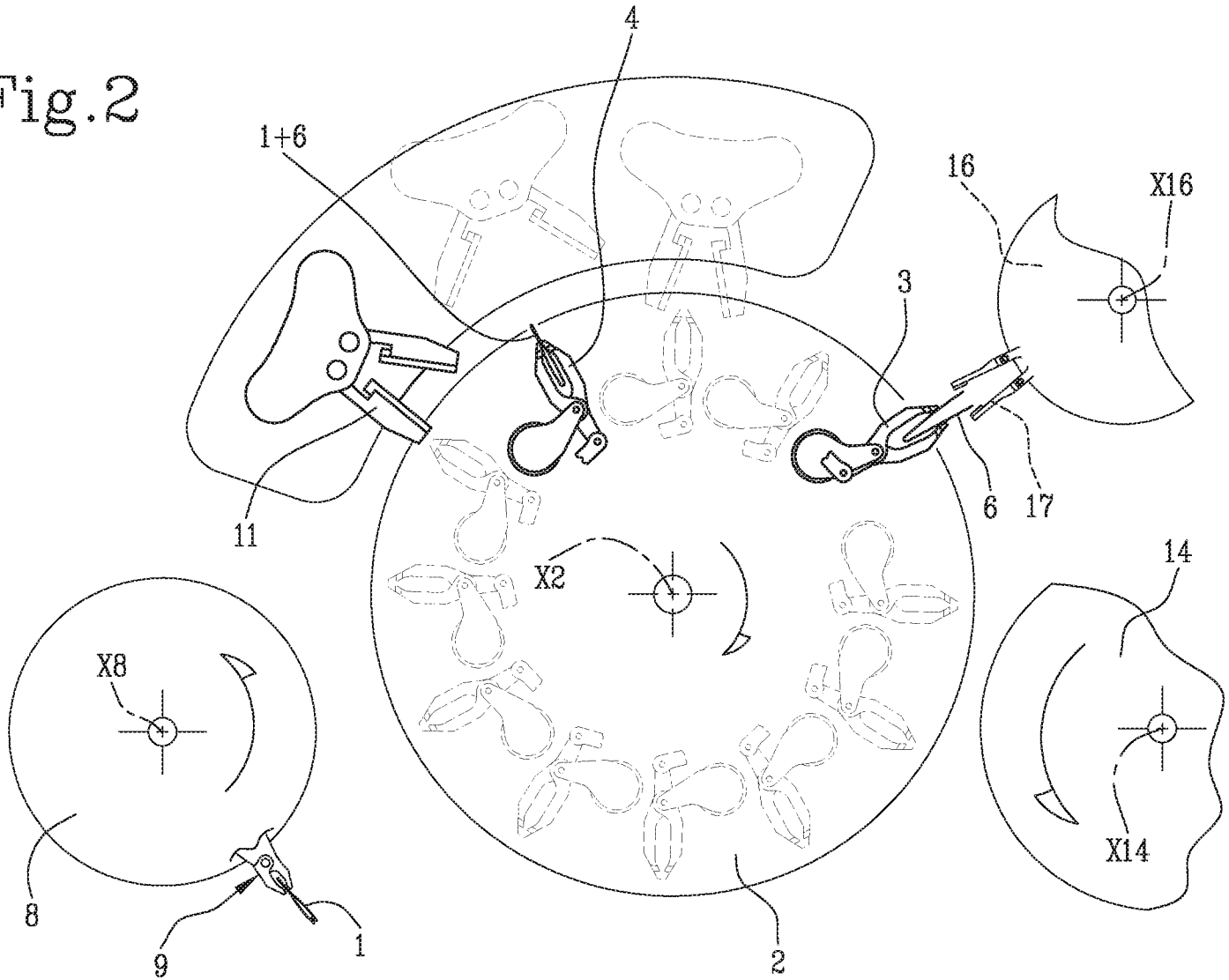
FIGS. 2 to 7 illustrate corresponding schematic front views, with some parts cut away to better illustrate others, of the unit for over-wrapping filter bags for infusion products in corresponding operating steps for forming, closing a sheet of over-wrapping material on the filter bag and unloading the end product thus obtained.

The forming station 5 is equipped with a feeding device 7 for feeding the single sheets 6 of over-wrapping material prepared in a U-shape, in phase synchronization with the rotation of the carousel 2, only on the first gripping means 3 (see FIG. 2).

Moreover, the over-wrapping unit 100 comprises a first drum 8 for transporting the formed filter bag 1, rotating about a second axis X8 of rotation parallel to the first axis X2 of rotation.

Figure 3:
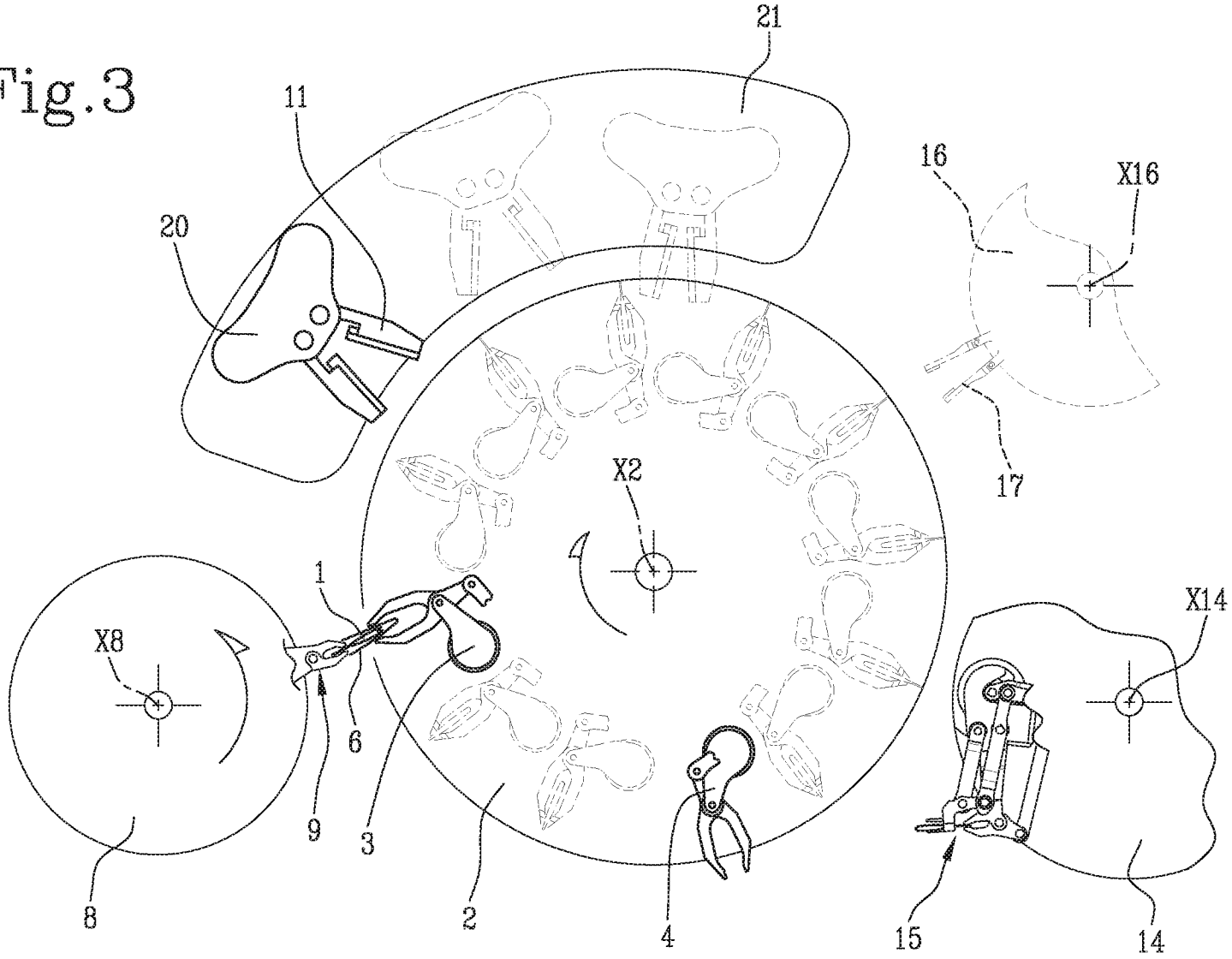

The first drum 8 has gripping means 9 configured to receive the filter bags 1 formed by a previous station or carousel G (illustrated with a dashed line in FIG. 1) and to release, in a synchronised fashion with the corresponding rotations, the same filter bags 1 only on the first gripping means 3 equipped with the U-shaped sheet 6 of over-wrapping material (see FIG. 3).

The first gripping means 3 are configured to enable positioning and retaining of the formed filter bag 1 inside the same U-shaped sheet 6 of over-wrapping material.

The over-wrapping unit 100 also comprising a closing station 10 of the sheet 6 of over-wrapping material on the formed filter bag 1 arranged close to the closed circular trajectory T of the first 3 and second 4 gripping means.

Figure 4:
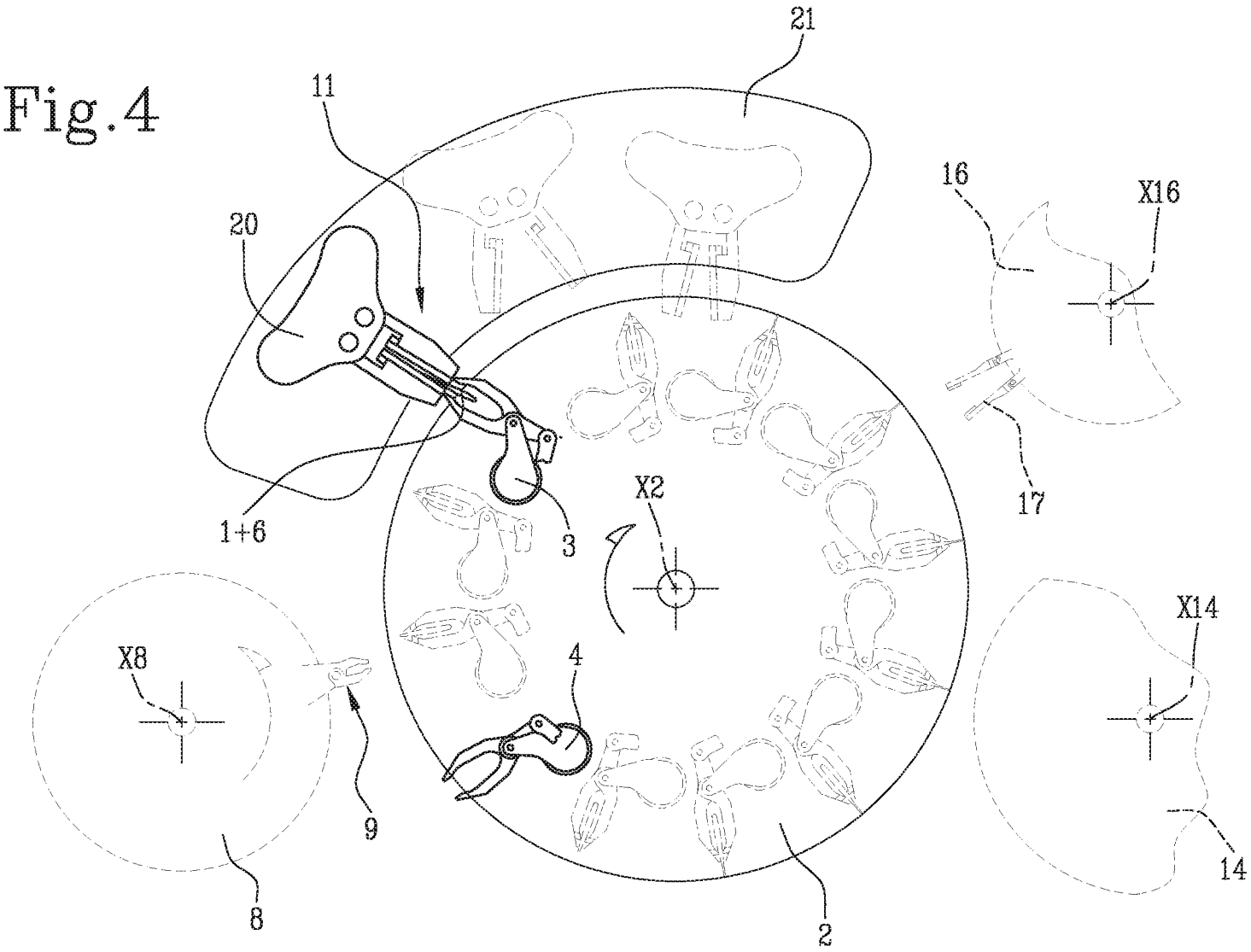
Figure 5:
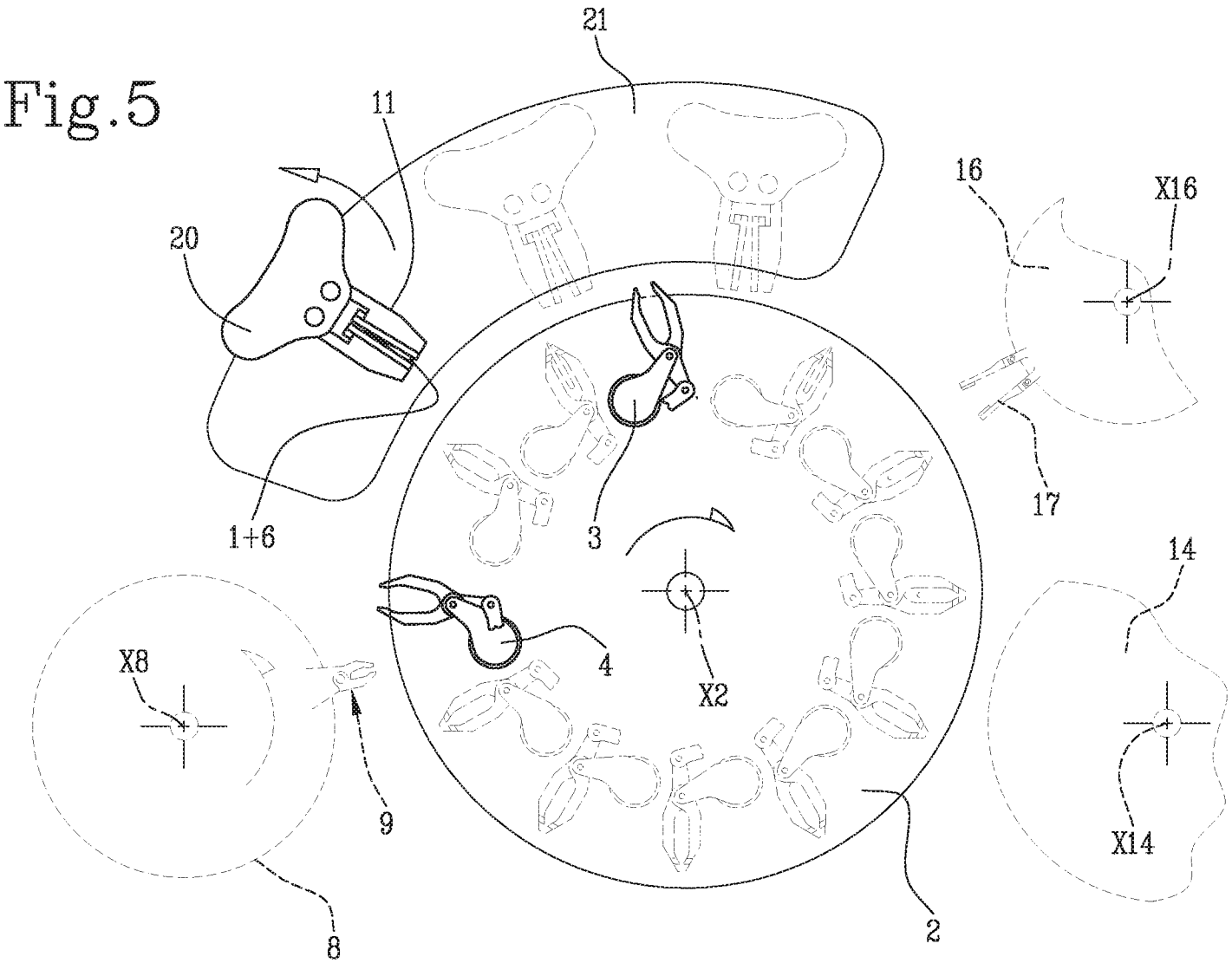
Figure 6:
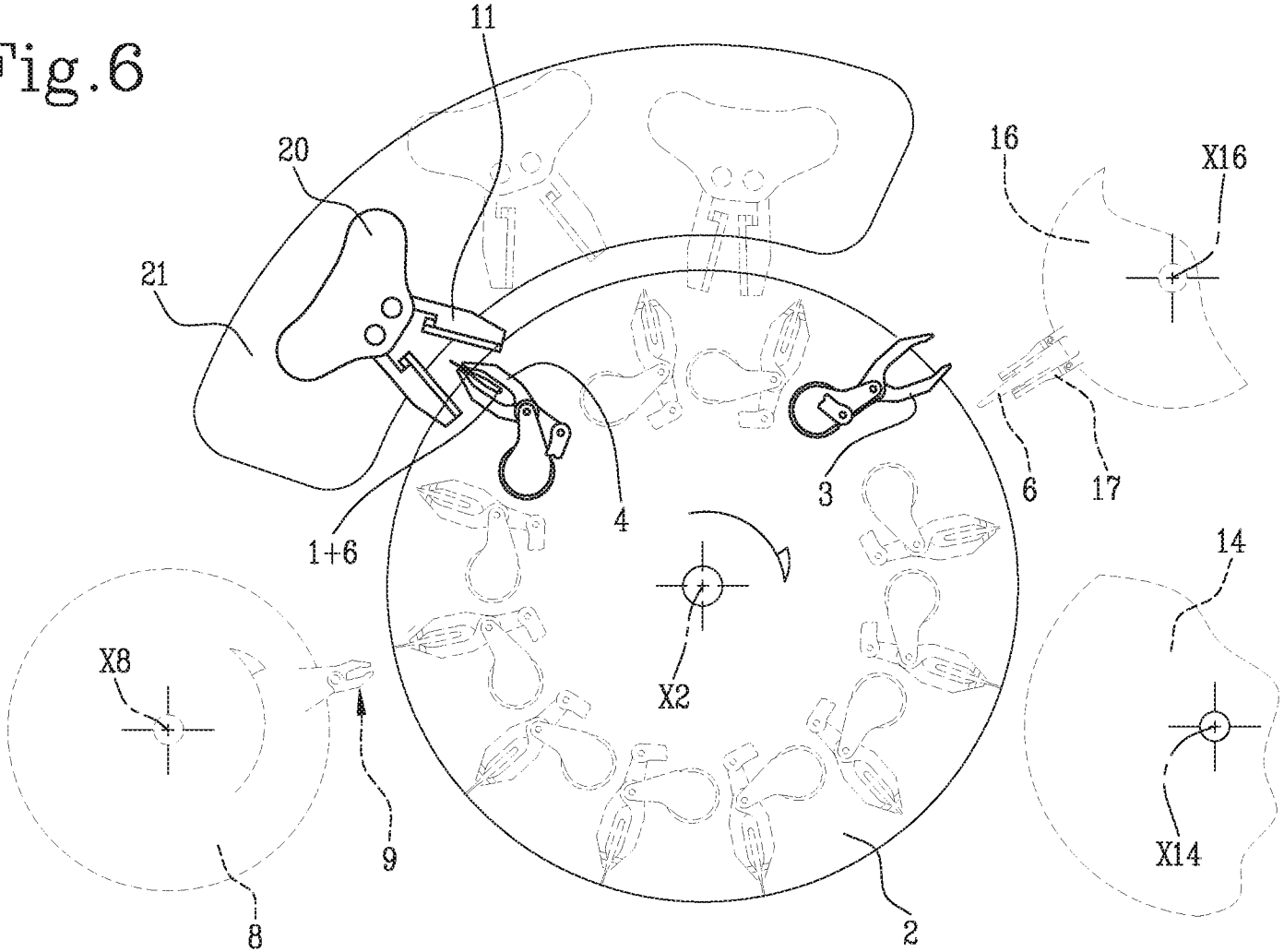

The closing station 10 is equipped with at least one sealing gripper 11 connected to movement means 12 which are able to move the sealing gripper 11, in synchrony with the rotation of the carousel 2, from a first position close to the carousel 2 (FIG. 4), for picking up the filter bag 1 formed with the sheet 6 of over-wrapping material from the first gripping means 3, to a second position away from the carousel 2, for closing the sheet 6 of over-wrapping material (FIG. 5) and, lastly, to a third position again close to the carousel 2, to release the filter bag 1 formed and closed by the over-wrapping material 6 only to the second gripping means 4 (FIG. 6).

In other words, the over-wrapping unit uses a combination of rotary carousel and "fixed" sealing station wherein the sealing gripper is combined, that is, synchronised, with a pair of gripping elements of which the first is designed only for receiving the sheet of over-wrapping material and the formed filter bag and its release to the sealing gripper, whilst the second gripping means is designed exclusively for receiving the sheet of over-wrapping material closed around the filter bag from the sealing gripper and the unloading of this finished product towards the collection or stacking station (as described in more detail below).

Thanks to this type of entry-exit combination of the bag with the sheet of over-wrapping material with two different gripping elements it is possible to obtain a correct sealing time on the gripper (interval between the first and second gripping units), maintaining high and continuous production speeds.

Figure 7:
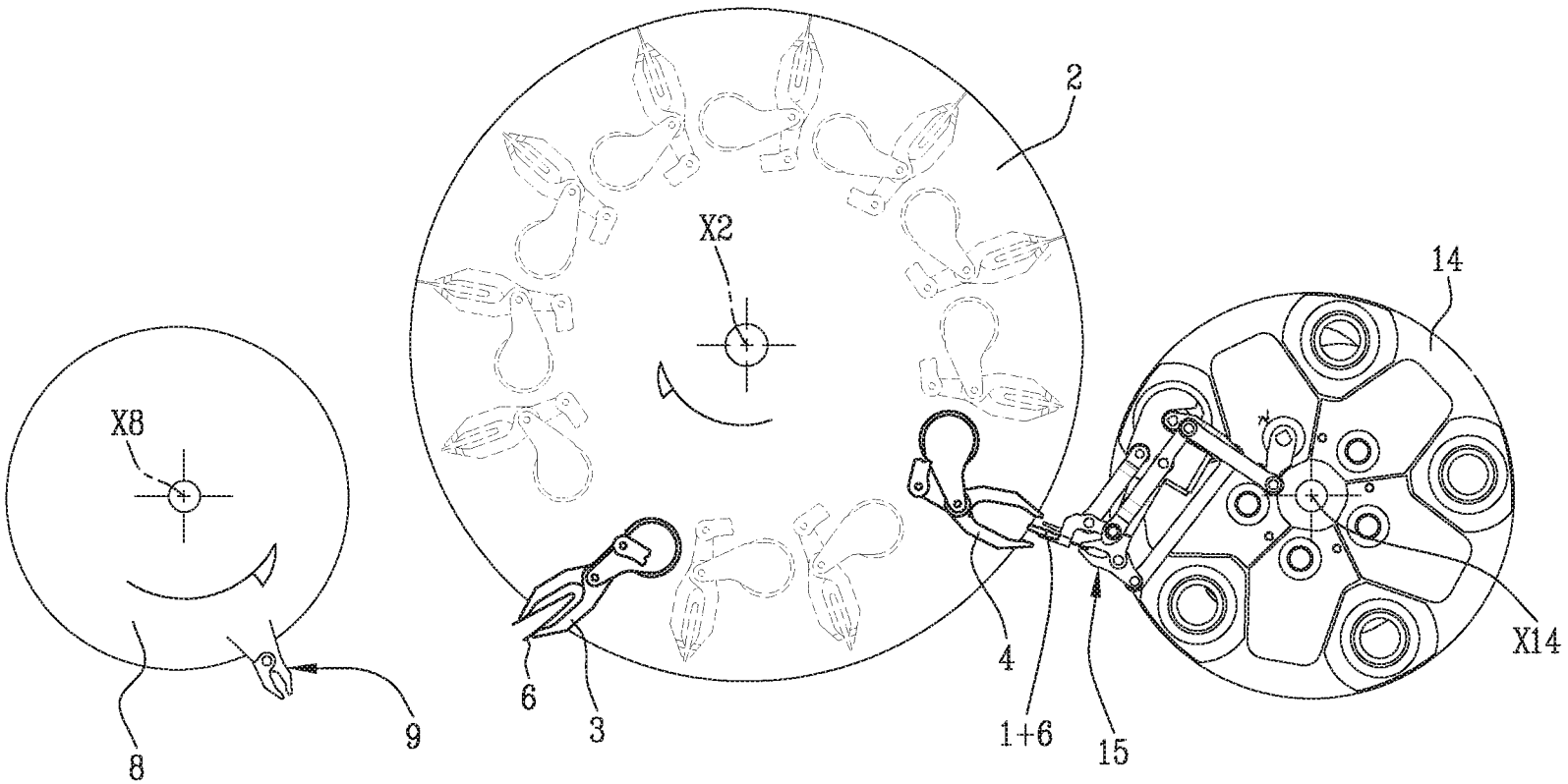

Preferably, the over-wrapping unit 100 comprises a receiving station 13 for receiving the formed filter bag 1 closed with the sheet 6 of over-wrapping material by only the second gripping means 4 (see FIG. 7).

It should be noted that the receiving station 13 is positioned close to the carousel 2.

In light of this, the station 13 for receiving the filter bag 1 closed with the sheet 6 of over-wrapping material comprises a second drum 14 rotating about a third axis X14 of rotation, parallel to the first X2 and to the second X8 axis of rotation.

The second drum 14 has a plurality of grippers 15, rotating with the second drum 14, configured to receive the filter bag 1 closed with the sheet 6 of over-wrapping material from only the second gripping means 4 and to release the same closed filter bag 1 in an accumulation zone (not illustrated) of the filter bags 1 closed with the sheet 6 of over-wrapping material.

Preferably, the above-mentioned device 7 for feeding sheets 6 of over-wrapping material comprises at least one third drum 16, rotating about a fourth axis X16 of rotation, parallel to the first X2 and second X8 axis of rotation.

In light of this, the third drum 16 is equipped with a plurality of grippers 17 each configured to prepare a single U-shaped sheet 6 of over-wrapping material at a time and to release it, inside only the first gripping means 3 with the U-shaped free ends of the sheet 6 of over-wrapping material facing towards the outside of the first gripping means 3 (FIG. 2).

It should be noted that the closing station 10 of the sheet 6 of over-wrapping material comprises a plurality of sealing grippers 11, 11*a*, 11*b* independent of one another and arranged one following another (in the case illustrated, there are, by way of example, three).

In light of this, the carousel 2 comprises at least one corresponding plurality of first 3, 3*a*, 3*b* and second 4, 4*a*, 4*b* gripping means arranged along the surface thereof.

Again in light of this, each pair of first 3, 3*a*, 3*b* and second 4, 4*a*, 4*b* gripping means is synchronized in the steps of releasing and receiving the filter bag 1 with the sheet 6 of over-wrapping material with a specific sealing gripper 11 or 11*a* or 11*b* of the plurality of sealing grippers.

FIGS. 2 to 7 illustrate with continuous line only a pair of gripping units (denoted by the numerals 3 and 4), only to simplify the operating steps which are identical for each pair of gripping elements.

The number of pairs of the pickup elements may vary as a function of the cycle times of the sealing grippers and of the feeding and unloading drums.

In the example shown in the drawings, there are six pairs of gripping elements and each gripper is correlated with two pairs of gripping elements.

Preferably, each first gripping means is a first gripper 3 connected to a first cam device 18 able to move the first gripper 3 between a plurality of operating positions, between a completely-open non-operating position, actuated by the first gripper 3 in a closed circular stretch of the trajectory T comprised between the sealing gripper 11 and the forming station 5 of the sheet of over-wrapping material for receiving the sheet 6 of over-wrapping material, and a completely closed operating position actuated in a closed circular stretch of the trajectory T comprised between the first drum 8, in which the first gripper 3 receives the formed filter bag 1 inside the sheet 6 of over-wrapping material, and the sealing gripper 11.

In light of this, each second gripping means is a second gripper 4 connected to a second cam device 19 able to move the second gripper 4 between at least one completely open first non-operating position, actuated by the second gripper 4 in a closed circular stretch of the trajectory T comprised between the receiving and unloading station 13 of the filter bag 1 closed with the sheet 6 of over-wrapping material and the sealing gripper 11 where the second gripper 4 receives the closed filter bag 1, and a closed operating position actuated by the second gripper 4 in a closed circular stretch of the trajectory T comprised between the sealing gripper 11, from which it receives the closed filter bag 1 and the receiving and unloading station 13 of the filter bag 1 closed with the sheet 6 of over-wrapping material where the second gripper 4 releases the closed filter bag 1.

Preferably, each sealing gripper 11 of the sheet 6 of over-wrapping material comprises a support 20 projecting from a fixed plate 21 and on which the sealing gripper 11 is hinged so as to be positioned along the closed circular trajectory T of the first 3 and second 4 gripping means, and above the first 3 and second gripping means 4 in passage.

The support 20 is connected to a connecting rod-crank unit 22, defining the movement means 12, which are able to rotate the sealing gripper 11 according to a closed elliptical trajectory so as to obtain the different gripping, sealing and release positions of the formed filter bag 1 with the sheet 6 of over-wrapping material.

It should be noted that the carousel 2, the first drum 8 and the at least one sealing gripper 11 of the closing station 10 are moved with continuous motion and in mutual phase synchronization.

In light of this, the second 14 and the third 16 drum are moved in continuous motion and in phase synchronization with one another and with the first drum 8, the carousel 2 and the at least one sealing gripper 11 of the closing station 10.

The invention also provides a method for closing a filter bag 1 for infusion products with a sheet 6 of over-wrapping material.

The method comprises the following steps:

- preparing a carousel 2 rotating about a first axis X2 and equipped with at least one first 3 and one second 4 gripping means movable in rotation about the first axis X2 of rotation along a closed circular trajectory T;
- preparing at least one sealing gripper 11, arranged outside the carousel 2 and close to the closed circular trajectory T of the first 3 and second 4 gripping means;
- housing a U-shaped sheet 6 of over-wrapping material inside only the first gripping means 3 prepared in an open receiving position;
- inserting a formed filter bag 1 inside the U-shaped sheet 6 of over-wrapping material arranged only in the first gripping means 3;
- passage of the formed filter bag 1 and the U-shaped sheet 6 of over-wrapping material from only the first gripping means (3) to the sealing gripper 11; the sealing gripper 11 is arranged in a position close to the carousel 2;
- closing of the sheet 6 of over-wrapping material about the formed filter bag 1 by the sealing gripper 11 during a moving away thereof from the carousel 2;
- releasing of the closed filter bag 1 in the sheet 6 of over-wrapping material to only the second gripping means 4 by the sealing gripper 11 during a further moving near of the sealing gripper (11) to the carousel 2;
- unloading of the filter bag 1 closed in the sheet 6 of over-wrapping material in a receiving station 13 of the closed filter bags 1.

The preset aims are fully achieved thanks to the structure of the over-wrapping unit just described.

In effect, the unit according to the invention is extremely flexible, configurable according to the type of over-wrap to be obtained, and with a high productivity.

It should be noted that the combination of a pair of gripping elements with two different functions in the arc of the closed circular trajectory of the carousel allows the presence of an external sealing unit which is able to obtain a high quality closing quality, thanks to the possibility of picking up bag and sheet of over-wrapping material from a first gripper and having the time necessary for the sealing before releasing the closed package on a second different gripper again on the same carousel.

This system therefore guarantees a high quality of the end product, a reduced overall size of all the stations necessary for the coupling between the components of the product thanks to the centrality of the carousel.

Moreover, the unit structured in this way has a high operational flexibility thanks to the possibility of combining, either activating or deactivating, several sealers and several pairs of gripping elements as a function of the operating speeds required by the entire machine.

This operational flexibility feature also increases with the possibility of programming the relative speeds of rotation of the carousel and of the sealing gripper as a function of the contact times of the gripper considered necessary for a correct closing of the sheet of over-wrapping material.

The invention claimed is:

1. A unit for over-wrapping filter bags for infusion products obtained from a machine for forming filter bags for infusion products starting from pieces of filter material each containing at least one dose of infusion product and including a formed filter bag, a thread and a tag; the unit for over-wrapping comprising at least:

a carousel rotating about a first axis of rotation and including at least one first and one second gripping devices including grippers movable in rotation about the first axis of rotation along a closed circular trajectory;

a forming station for forming single sheets of over-wrapping material arranged adjacent to the closed circular trajectory of the first and second gripping devices;

a feeding device, positioned in the forming station, for feeding the single sheets of over-wrapping material prepared in a U-shape, in phase synchronization with the rotation of the carousel, only on the first gripping device;

a first drum configured for transport of the formed filter bag, rotating about a second axis of rotation parallel to the first axis of rotation, and having a gripping device configured to receive the formed filter bags from a preceding station or carousel and to release, in phase synchronization with a corresponding rotation with the carousel, the filter bags only on the first gripping device including the U-shaped sheet of over-wrapping material; the first gripping devices being configured to enable positioning and retaining of the formed filter bag inside the same U-shaped sheet of over-wrapping material;

a closing station of the sheet of over-wrapping material on the formed filter bag arranged adjacent to the closed circular trajectory of the first and second devices; the closing station including a sealing gripper connected to movement elements able to move the sealing gripper, in phase synchronization with the rotation of the carousel, from a first position close to the carousel, for collecting the formed filter bag with the sheet of over-wrapping material from the first gripping devices, to a second position away from the carousel, for closing the sheet of over-wrapping material and, lastly, to a third position newly and again close to the carousel, for release of the formed filter bag closed by the sheet of over-wrapping material only to the second gripping device.

2. The unit according to claim 1, comprising a receiving station for receiving the formed filter bag closed with the sheet of over-wrapping material by only the second gripping devices; the receiving station being arranged close to the carousel.

3. The unit according to claim 2, wherein the receiving station of the filter bag closed with the sheet of over-wrapping material comprises a second drum rotating about a third axis of rotation, parallel to the first and second axis of rotation; the second drum having a plurality of grippers, rotating with the second drum, configured to receive the filter bag closed with the sheet of over-wrapping material only from the second gripping devices and to release the closed filter bag in an accumulation zone of the filter bags closed with the sheet of over-wrapping material.

4. The unit according to claim 2, wherein the second and third drum are moved in continuous motion and in phase synchronization with one another and with the first drum, the carousel and the sealing gripper of the closing station.

5. The unit according to claim 1, wherein the feeding device of the sheets of over-wrapping material comprises at least one third drum rotating about a third axis of rotation, parallel to the first and second axis of rotation; the third drum including a plurality of grippers each configured to prepare a single one of the U-shaped sheets of over-wrapping material at a time and to release the single one of the U-shaped sheets of over-wrapping material it, inside only the first gripping devices with the U-shaped ends of the sheet of over-wrapping material facing towards the outside of the first gripping devices.

6. The unit according to claim 1, wherein the closing station of the sheet of over-wrapping material comprises a plurality of sealing grippers independent of one another and arranged one following another, and wherein the carousel comprises at least one corresponding plurality of first and second gripping devices arranged along a surface thereof and wherein each pair of first and second gripping devices is synchronized in the steps of releasing and receiving the filter bag with the sheet of over-wrapping material with a specific sealing gripper of the plurality of sealing grippers.

7. The unit according to claim 1, wherein each first gripping devices is a first gripper connected to a first cam device configured to move the first gripper between a plurality of operating positions, between a completely-open non-operating position, actuated by the first gripper in a closed circular stretch of the trajectory comprised between the sealing gripper and the forming station of the sheet of over-wrapping material for receiving the sheet of over-wrapping material, and a closed operating position actuated in a closed circular stretch of the trajectory comprised between the first drum, in which the first gripper receives the formed filter bag inside the sheet of over-wrapping material, and the sealing gripper.

8. The unit according to claim 1, wherein each second gripping device is a second gripper connected to a second cam device configured to move the second gripper between at least one completely open first non-operating position, actuated by the second gripper in a closed circular stretch of the trajectory comprised between a receiving and unloading station of the filter bag closed with the sheet of over-wrapping material and the sealing gripper where the second gripper receives the closed filter bag, and a closed operating position actuated by the second gripper in a closed circular stretch of the trajectory comprised between the sealing gripper, from which the second gripper receives the closed filter bag and the receiving and unloading station of the filter bag closed with the sheet of over-wrapping material where the second gripper releases the closed filter bag.

9. The unit according to claim 1, and further comprising a plurality of the sealing grippers, wherein each sealing gripper of the sheet of over-wrapping material comprises a support projecting from a fixed plate and on which the sealing gripper is hinged so as to be positioned along the closed circular trajectory of the first and second gripping devices, and above the first and second gripping devices in passage; the support being connected to a connecting rod-crankshaft unit defining the movement elements, able to rotate the sealing gripper according to a closed elliptical trajectory to obtain the different gripping, sealing and release positions of the formed filter bag with the sheet of over-wrapping material.

10. The unit according to claim 1, wherein at least the carousel, the first drum and the sealing gripper of the closing station are moved with continuous motion and in mutual phase synchronization.

11. A method for forming a filter bag for infusion products, with a sheet of over-wrapping material, the method comprising the following steps:

providing a carousel rotating about a first axis and including at least one first and one second gripping devices including grippers movable in rotation about the first axis of rotation along a closed circular trajectory;

providing a sealing gripper, arranged outside the carousel and adjacent to the closed circular trajectory of the first and second gripping devices;

housing a U-shaped sheet of over-wrapping material inside only the first gripping device prepared in an open receiving position;

inserting a formed filter bag inside the U-shaped sheet of over-wrapping material arranged in the first gripping device;

passing the formed filter bag and the U-shaped sheet of over-wrapping material from only the first gripping device to the sealing gripper; the sealing gripper being arranged in a position adjacent close to the carousel;

closing the sheet of over-wrapping material about the formed filter bag by the sealing gripper during a moving away thereof from the carousel;

releasing the closed filter bag in the sheet of over-wrapping material to only the second gripping device by the sealing gripper during a further moving near of the sealing gripper to the carousel;

unloading the filter bag closed in the sheet of over-wrapping material in a receiving station of the closed filter bags.

* * * * *